US005489887A

United States Patent [19]

Porras

[11] Patent Number: 5,489,887

[45] Date of Patent: Feb. 6, 1996

[54] WAITER SIGNALING DEVICE

[76] Inventor: Miguel A. Porras, 10332 Ashton Ct. Apt 301, Thornton, Colo. 80229

[21] Appl. No.: 169,416

[22] Filed: Dec. 20, 1993

[51] Int. Cl.[6] ..... G08B 5/00

[52] U.S. Cl. ..... 340/332; 340/321; 340/286.09; 340/473; 362/414; D10/114; D26/106

[58] Field of Search ..... 340/332, 321, 340/286.06, 473, 286.09; 362/410, 412, 413, 414, 157, 183, 806; 116/202, 205; D10/114; D26/106

[56] References Cited

U.S. PATENT DOCUMENTS

| | | | |
|---|---|---|---|
| D. 328,571 | 8/1992 | Hauser | D10/114 |
| D. 349,071 | 7/1994 | Fields et al. | 362/410 |
| 2,305,656 | 12/1942 | Yopp | 340/473 |
| 2,415,991 | 2/1947 | Christian | 340/321 |
| 2,438,652 | 3/1948 | Smith | 340/321 |
| 2,505,365 | 4/1950 | Roberts | 340/321 |
| 2,563,693 | 8/1951 | Russell | 340/321 |
| 2,565,980 | 8/1951 | Moore | 340/321 |
| 2,611,019 | 9/1952 | Warner | 340/321 |
| 2,638,583 | 5/1953 | Edwards | 340/321 |
| 2,690,552 | 9/1954 | Kiibus | 340/321 |
| 3,071,764 | 1/1963 | Frezieres | 340/321 |
| 3,714,410 | 1/1973 | Olsen | 240/614 R |
| 3,810,164 | 5/1974 | Lambert | 340/332 |
| 4,250,491 | 2/1981 | Dotson | 340/321 |
| 5,355,115 | 10/1994 | Goor et al. | 340/321 |

*Primary Examiner*—Brent Swarthout
*Assistant Examiner*—Nina Tong

[57] ABSTRACT

A waiter signaling device comprising a pole having a lower base and an upper tip end, a light source coupled to the tip end, a power source for energizing the light source, a switch mechanism connected to the pole and operable in one orientation to energize the light source, thereby generating a signal indicating that service is required, and in another orientation to deenergize the light source, thereby generating a signal indicating that service is not required, and a coupling mechanism for coupling the base end of the pole to a table.

1 Claim, 4 Drawing Sheets

FIG 5
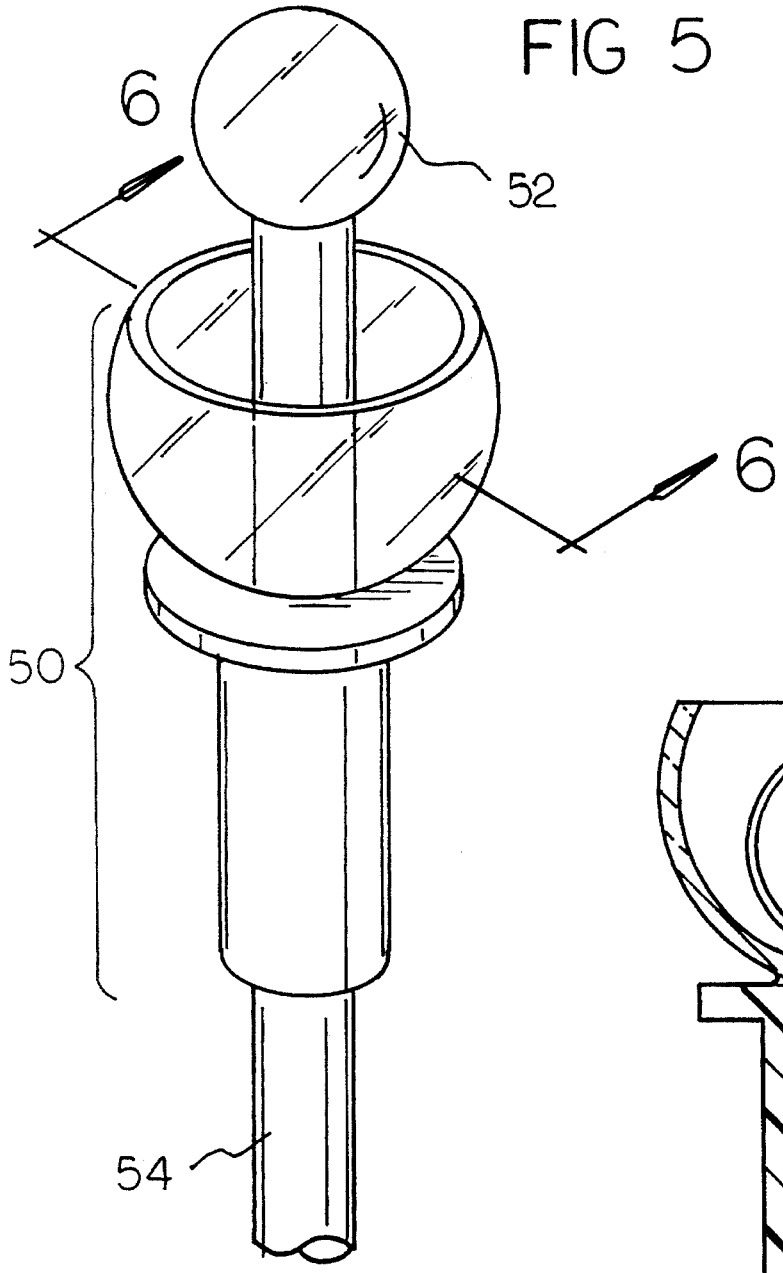
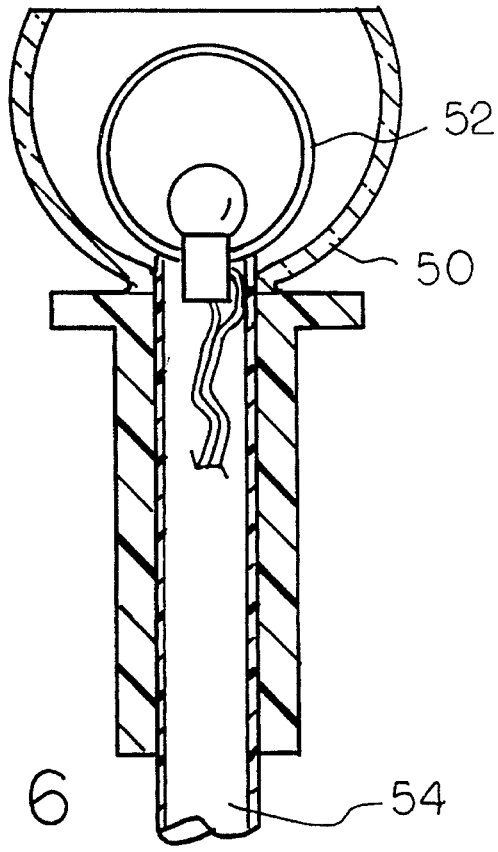
FIG 6

WAITER SIGNALING DEVICE

BACKGROUND OF THE INVENTION

1. Field of the Invention

The present invention relates to a waiter signaling device and more particularly pertains to a device which may be used to signal a waiter for service.

2. Description of the Prior Art

The use of devices which can be used to signal a waiter for service is known in the prior art. More specifically, devices heretofore devised and utilized for the purpose of signaling a waiter for service are known to consist basically of familiar, expected and obvious structural configurations, notwithstanding the myriad of designs encompassed by the crowded prior art which have been developed for the fulfillment of countless objectives and requirements.

For example, a U.S. Pat. No. 3,071,764 to Frezieres, U.S. Pat. No. 4,250,491 to Dotson, and U.S. Pat. No. Des. 328,571 illustrate devices used to signal a waiter for service. Each device includes an illumination means coupled to a freestanding base.

Other patents that illustrate components generally related to the invention are U.S. Pat. No. 3,821,707 to Peters and U.S. Pat. No. 4,222,111 to Sloan et al. Each device includes an apparatus for monitoring the status of requests for waiter service.

While these devices fulfill their respective, particular objective and requirements, the aforementioned patents do not describe a waiter signaling device that minimizes the space required for its use on a table, maintains its relative position on a table even when the table is bumped or moved, and contains an integral power supply that may be coupled to different tables in a variety of ways, enabling the power supply to be hidden from view, and enabling the signaling device to be used in areas where commercially supplied electrical power is not available.

In this respect, the waiter signaling device according to the present invention substantially departs from the conventional concepts and designs of the prior art, and in so doing provides an apparatus primarily developed for the purpose of signaling a waiter for service.

Therefore, it can be appreciated that there exists a continuing need for new and improved waiter signaling device which can be used to signal a waiter for service. In this regard, the present invention substantially fulfills this need.

SUMMARY OF THE INVENTION

In view of the foregoing disadvantages inherent in the known types of devices for signaling a waiter for service now present in the prior art, the present invention provides an improved waiter signaling device wherein the same can be utilized for signaling a waiter for service. As such, the general purpose of the present invention, which will be described subsequently in greater detail, is to provide a new and improved waiter signaling device for signaling a waiter for service which has all the advantages of the prior art and none of the disadvantages.

To attain this, the present invention essentially comprises a rigid and upright hollow pole having a lower base end and an upper tip end, a light source coupled to the tip end, a translucent and globular container having an opening disposed thereon for receiving the light source therein, the container adapted to be coupled to the tip end, a hollow box having a magnet, a pile type fastener, and an adhesive strip coupled thereto, wherein the magnet, pile type fastener, and adhesive strip are used to secure the box to a table, the box further adapted to hold a power source therein for supplying power to the light source, a power cable disposed within the hollow pole and having a first end coupled to the light source and a second end adapted to be coupled to a power source within the container, a switch connected to the pole and power cable, the switch operable in one orientation to energize the cable, thereby activating the light source and presenting a signal indicating that service is required, and in another orientation to deenergize the cable, thereby deactivating the light source and presenting a signal indicating that service is not required, and a clamp coupled to the base end of the pole, the clamp further comprising a rigid and generally U-shaped member having a top end and a bottom end, the bottom end having a threaded hole disposed thereon, a rigid and elongated cylinder having a first end and a second end, the first end threadably coupled to the U-shaped member through the threaded hole, and a handle coupled to the second end of the cylinder to incrementally advance the first end of the cylinder toward the top end of the U-shaped member for securing a table top therebetween.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved waiter signaling device which has all the advantages of the prior art and none of the disadvantages.

It is another object of the present invention to provide a new and improved waiter signaling device which may be easily and efficiently manufactured and marketed.

It is a further object of the present invention to provide a new and improved waiter signaling device which is of a durable and reliable construction.

An even further object of the present invention is to provide a new and improved waiter signaling device which is susceptible of a low cost of manufacture with regard to both materials and labor, and which accordingly is then susceptible of low prices of sale to the consuming public, thereby making such a waiter signaling device economically available to the buying public.

Still yet another object of the present invention is to provide a new and improved waiter signaling device which provides in the apparatuses and methods of the prior art some of the advantages thereof, while simultaneously overcoming some of the disadvantages normally associated therewith.

Still another object of the present invention is to provide a new and improved waiter signaling device that minimizes the space required for its use on a table.

Yet another object of the present invention is to provide a new and improved waiter signaling device that maintains its relative position on a table even when the table is bumped or moved.

Yet another object of the present invention is to provide a new and improved waiter signaling device that contains an integral power supply that is coupled to different tables in a variety of ways, enabling the power supply to be hidden from view, and enabling the signaling device to be used in areas where commercially supplied electrical power is not available, such as a patio, terrace, or garden.

Yet another object of the present invention is to provide a new and improved waiter signaling device that enables a patron to readily signal a waiter when service is desired without having to signal by hand or voice.

Yet another object of the present invention is to provide a new and improved waiter signaling device that enables a waiter to know when a patron desires service, thereby avoiding irritating, needless, or embarrassing interruptions, such as disrupting an important conversation between patrons or soliciting service when a patron's mouth is full of food.

Yet another object of the present invention is to provide a new and improved waiter signaling device that can provide illumination to an area when primary light sources fail unexpectedly, such as during a commercial power outage, thereby helping to reduce injury to patrons who may not be seated at the time.

Even still another object of the present invention is to provide a waiter signaling device comprising a pole having a lower base end and an upper tip end, a light source coupled to the tip end, a power source for energizing the light source, a switch means connected to the pole and operable in one orientation to energize the light source, thereby generating a signal indicating that service is required, and in another orientation to deenergize the light source, thereby generating a signal indicating that service is not required, and coupling means for coupling the base end of the pole to a table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a view of the upper portion of the device constructed in accordance with an alternate embodiment of the invention.

FIG. 6 is a plan view of the upper portion of the device taken along the line 6—6 of FIG. 5.

DESCRIPTION OF THE PREFERRED EMBODIMENT

Figure 1:
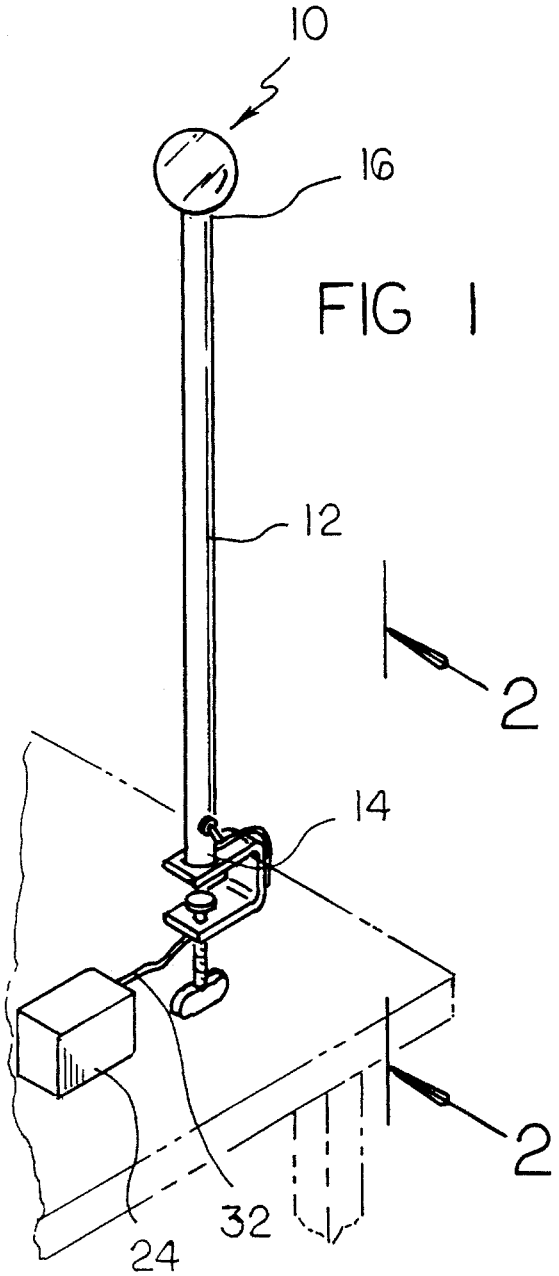
FIG. 1 is a perspective view of the waiter signaling device constructed in accordance with the principles of the present invention.
Figure 2:
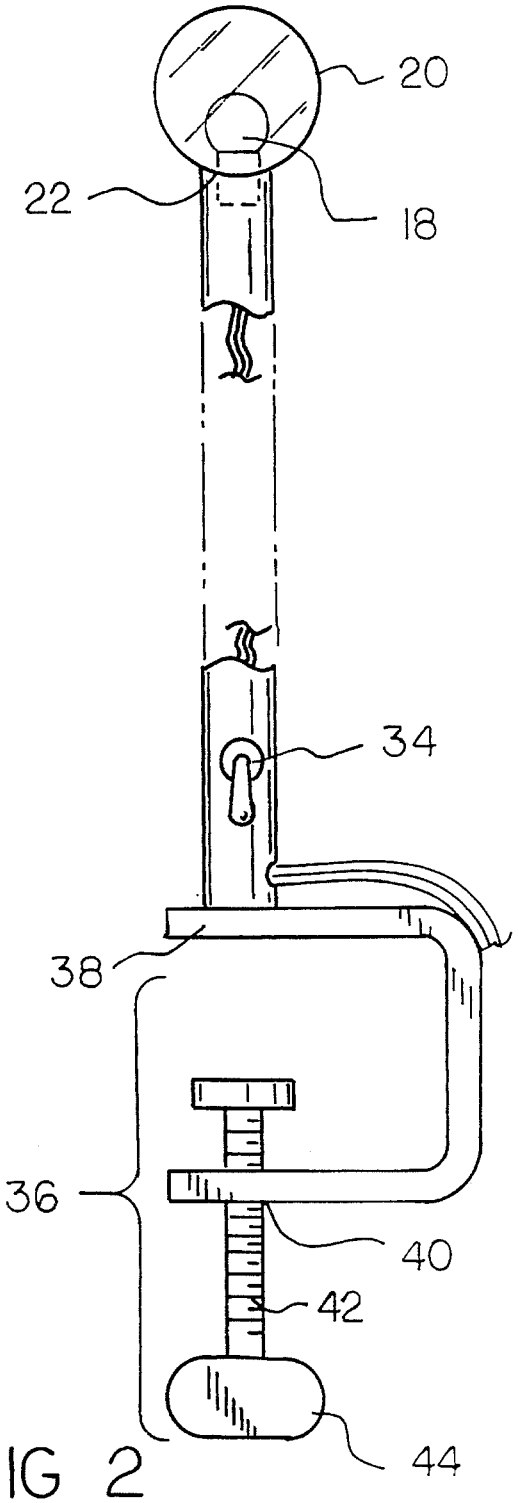
FIG. 2 is a side schematic view of the waiter signaling device of FIG. 1 taken along the line 2—2.
Figure 3:
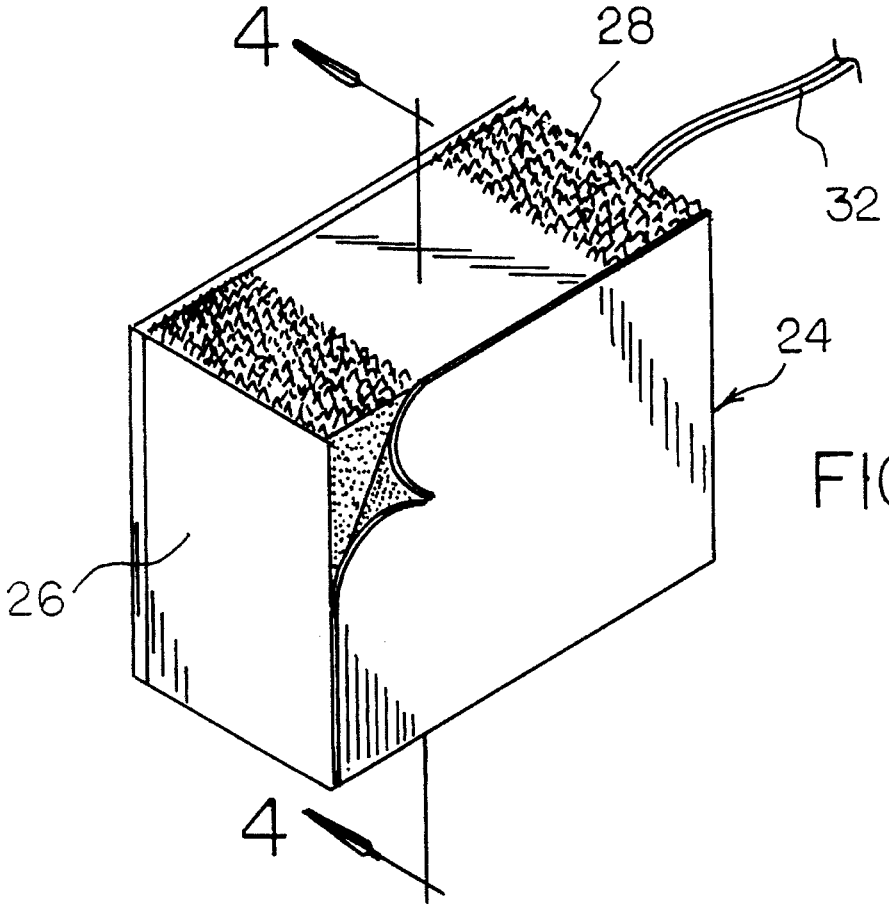
FIG. 3 is an enlarged view of the box that holds the power source as shown in FIG. 1.
Figure 4:
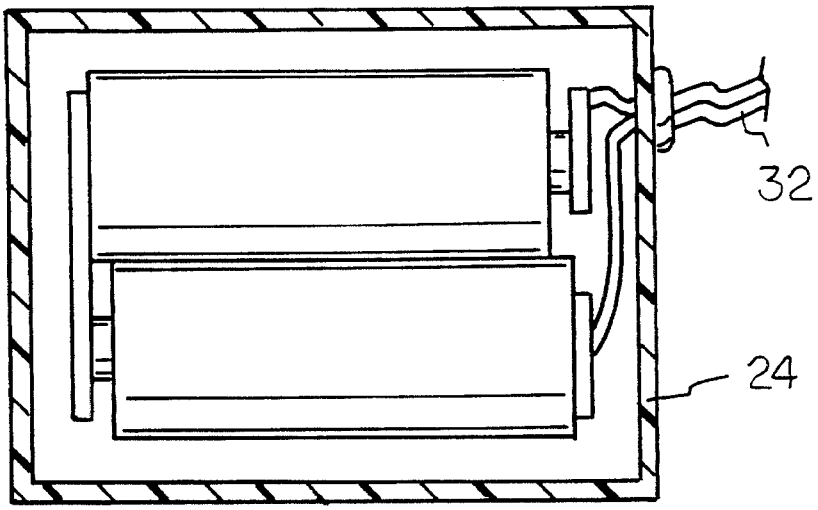
FIG. 4 is a plan view of the interior of the box that holds the power source taken along the line 4—4 of FIG. 3.

With reference now to the drawings, and in particular to FIG. 1 thereof, a new and improved waiter signaling device embodying the principles and concepts of the present invention and generally designated by the reference numeral 10 will be described.

The waiter signaling device 10 comprises a rigid and upright hollow pole 12 having a lower base end 14 and an upper tip end 16. A light source 18 is coupled to the tip end. The light source can be a three volt bulb or any other bulb that would provide adequate signaling and illumination capability.

The device includes a translucent and globular container 20. The container has an opening 22 disposed thereon for receiving the light source 18 and is adapted to be coupled to the tip end 16.

The device includes a hollow box 24 adapted to hold a power source therein for supplying power to the light source. Power can be supplied by batteries, enabling the signaling device to be used in areas where commercial power is not available, such as gardens, terraces, or patios.

The box has a magnet 26, a pile type fastener 28, and an adhesive strip 30 coupled thereto. The magnet, pile type fastener, and adhesive strip are adapted to secure the box to a table. For example, the magnet can be used to secure the box to a metal table, the pile type fastener can be used to secure the box to a table having a complementary pile type fastener coupled thereto. The adhesive strip can be used when the metal or pile type fasteners are not appropriate.

A power cable 32 is disposed within the hollow pole. Such cable has a first end coupled to the light source 18 and a second end adapted to be coupled to a power source within the box 24.

A switch 34 is connected to the pole 12 and power cable 32. The switch is operable in one orientation to energize the cable, thereby activating the light source and presenting a signal indicating that service is required. In another orientation the switch is operable to deenergize the cable, thereby deactivating the light source and presenting a signal indicating that service is not required.

The device includes a clamp 36 that is coupled to the base end of the pole. The clamp includes a rigid and generally U-shaped member 38 having a top end and a bottom end. The bottom end has a threaded hole 40 disposed thereon.

The clamp includes a rigid and elongated cylinder 42 having a first end and a second end. The first end is threadably coupled to the U-shaped member 38 through the threaded hole 40. The clamp includes a handle 44 coupled to the second end of the cylinder to incrementally advance the first end of the cylinder toward the top end of the U-shaped member for securing a table top therebetween. The clamp allows the device to be positioned on a table such that the device remains stationary even if the table is bumped or moved.

The second embodiment of the present invention is shown in FIGS. 5 and 6 and includes a different type of translucent container 50. The light source 52 is colored to define a first signal. The container is colored to define a second signal and is slidably disposed on the pole 54. The first signal is generated when the container is disposed away from the light source and the second signal is generated when the light source is disposed within the container.

Figure 7:
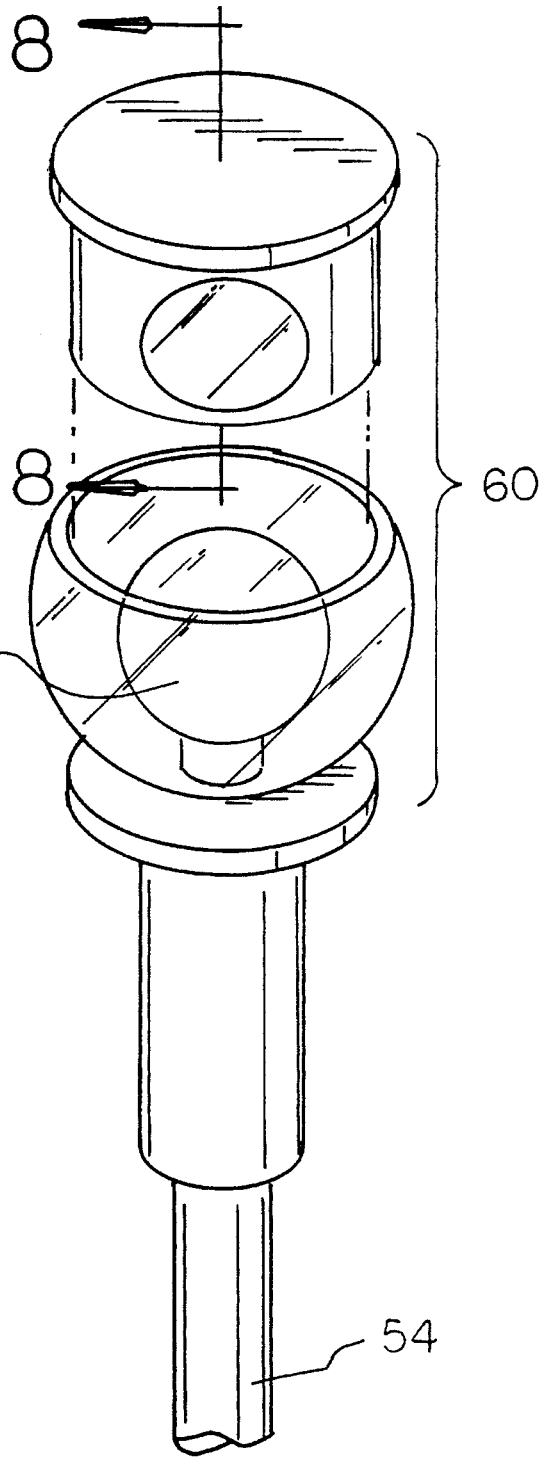
FIG. 7 is a side schematic view of the upper portion of the device constructed in accordance with yet another embodiment of the invention.
Figure 8:
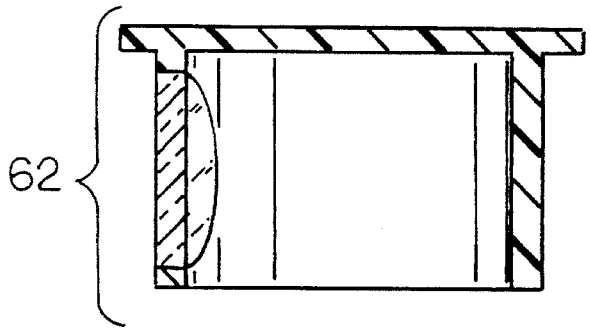
FIG. 8 is a side schematic view of the directional lens taken along the line 8—8 of FIG. 7.

The third embodiment of the present invention is shown in FIGS. 7 and 8 and includes a translucent container 60 with a rotatable and directional lens 62 coupled thereto. The lens is positionable such that the signals generated by the light source 64 are directed toward a desired location.

The present invention is safe and easy to use in high traffic areas like restaurants because it is self-contained. it can be made in a variety of decorative styles and colors to fit any type of table. In addition to being bolted to a table, the device can also be screwed in, attached with hook-and-loop material, or built into the table. The device also serves as an emergency light. Since it is battery powered, it can be switched on during a power outage thereby reducing the risk of injury to those who may not be seated at the time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A waiter signaling device comprising:

a one-piece rigid and upright hollow pole of a cylindrical configuration having an axis and having a lower base end and an upper tip end;

a light source coupled to the tip end;

a translucent and globular container having an opening disposed thereon for receiving the light source therein, the container adapted to be coupled to the tip end;

a hollow box having a magnet, a pile type fastener, and an adhesive strip coupled thereto, wherein the magnet, the pile type fastener, and the adhesive strip are used to secure the box to a table, the box further including a power source therein solely for supplying power to the light source;

a power cable disposed within the hollow pole and having a first end coupled to the light source and a second end adapted to be coupled to the power source within the box;

a switch connected to the pole and electrically coupled to the power cable, the switch operable in one orientation to energize the cable, thereby activating the light source and presenting a signal indicating that service is required, and in another orientation the deenergize the cable, thereby deactivating the light source and presenting a signal indicating that service is not required; and a clamp coupled to the base end of the pole, the clamp further comprising a rigid and generally U-shaped member having a top end and a bottom end with the bottom end having a threaded hole disposed thereon and the top end receiving and supporting the lower base end of the pole, a rigid and elongated cylinder having a first end and a second end with the first end threadably coupled to the U-shaped member through the threaded hole, the cylinder being rotatable about an axis of rotation aligned with the axis of the pole, and a handle coupled to the second end of the cylinder to incrementally advance the first end of the cylinder toward the top end of the U-shaped member for securing a table top therebetween.

* * * * *